US005975289A

United States Patent [19]

Linder

[11] Patent Number: 5,975,289

[45] Date of Patent: Nov. 2, 1999

[54] CONTAINER FOR TRANSPORT OF PRINTED PRODUCTS

[75] Inventor: Heinz Linder, Zofingen, Switzerland

[73] Assignee: GRAPHA-Holding AG, Switzerland

[21] Appl. No.: 08/893,370

[22] Filed: Jul. 15, 1997

[30] Foreign Application Priority Data

Jul. 29, 1996 [CH] Switzerland ..... 1881/96

[51] Int. Cl.[6] ..... B65D 21/04

[52] U.S. Cl. ..... 206/215; 206/449; 206/505; 220/4.22; 220/759; 294/158

[58] Field of Search ..... 206/215, 449, 206/505, 517, 518, 555; 220/4.21, 4.22, 4.24, 4.26, 4.27, 759, 760; 294/142, 145, 158, 164

[56] References Cited

U.S. PATENT DOCUMENTS

| | | | |
|---|---|---|---|
| 1,009,360 | 11/1911 | Watt | 206/737 |
| 1,271,201 | 7/1918 | Muegge | 206/737 |
| 2,961,123 | 1/1960 | Boydak et al. | 206/517 |
| 3,275,188 | 9/1966 | Wilson | 206/505 |
| 3,366,274 | 1/1968 | Hinrichs | 206/517 |
| 3,927,812 | 12/1975 | Winters et al. | 220/759 |
| 5,699,914 | 12/1997 | Broersma | 206/518 |

FOREIGN PATENT DOCUMENTS

| | | | |
|---|---|---|---|
| 903125 | 8/1960 | United Kingdom | 206/517 |

*Primary Examiner*—Jim Foster
*Attorney, Agent, or Firm*—Venable; George H. Spencer; Robert Kinberg

[57] ABSTRACT

A container includes two container halves and a hinge connecting the two container halves so that the two container halves can be pivoted between a folded up position and a folded down position. In the folded up position the container includes a bottom, four side walls and an upper filling opening and is stackable on another like container in the folded up position, and in the folded down position the container is nestable with another like container in the folded down position.

11 Claims, 3 Drawing Sheets

CONTAINER FOR TRANSPORT OF PRINTED PRODUCTS

CROSS-REFERENCE TO RELATED APPLICATIONS

This application claims the right of priority of application CH 1996 1881/96 filed Jul. 29, 1996, in Switzerland, the disclosure of which is incorporated herein by reference.

BACKGROUND OF THE INVENTION

The invention concerns a container with a bottom and four side walls and an upper filling opening for use, in particular, for transport of magazines or newspapers, e.g. from a shipping department to a retail shop.

Printed products and in particular daily newspapers and magazines must be transported from the shipping department directly to the retail areas or external distribution centers. Up to now, printed products were wrapped in a foil and tied together for transport. This procedure is not environmentally friendly. In addition, even foil-covered printed products are protected only marginally against damage during the transport.

A container designed to avoid the above-mentioned disadvantages has been suggested in which, with the aid of a filling machine, the container is filled in the shipping department with a predetermined number of printed products. These remain in the container until they reach the retail shop or external distribution center. Since the printed products do not have to be covered with foil and tied together and the container can be used repeatedly, it would represent an improvement from an ecological point of view. In addition, it would protect the printed products better against damage. The shipment with such a container would on the whole be more economical, cost-saving and efficient. However, in practical operations this container did not prevail.

SUMMARY OF THE INVENTION

It is an object of the invention to provide a container of the above-mentioned type, which is better suited for the transport of newspapers and magazines from a shipping department to a retail shop.

The above and other objects are accomplished according to the invention by the provision of a container including two container halves and a hinge connecting the two container halves so that the two container halves can be pivoted between a folded up position and a folded down position, wherein in the folded up position the container includes a bottom, four side walls and an upper filling opening and is stackable on another like container in the folded up position, and in the folded down position the container is nestable with another like container in the folded down position.

Thus, the novel container according to the invention has two container halves opening by hinges to the side, which when opened and lying on the side can be nested or inserted into each other. Moreover, when in the folded up and standing position, the containers can be stacked on top of one another. One essential advantage of the inventive container is the extremely low box height of, for example, 4.5 cm. As a result of this, the containers can be nested into each other, in the folded down position, in a compact way and can be made available as empty merchandise, e.g. forming a stack of 30 items. Since many containers can be provided in a comparatively small area, it is considerably easier and faster to make the containers available while simultaneously allowing a faster filling. The containers, which can be inserted into each other, one above the other, to form stacks can exercise their function as buffers more effectively than has been possible so far.

A particularly secure stacking is possible if, according to a further feature of the invention, the two container halves each include an edge near the filling opening that respectively projects into the filling opening, and a recess that is provided in the bottom that corresponds to this edge. The recess is preferably formed so as to avoid a displacement in any direction of two neighboring, i.e. stacked, containers.

To prevent an undesirable folding down of the two container halves, another feature of the invention is to provide means for releaseably latching together the two container halves while they are folded up.

If two facing side walls have respectively at least one opening, then means for guiding the printed products during the filling of the container can be pivoted into this opening.

It is particularly easy to handle the container if the container has a carrying device that can be inserted into the filling opening and can be attached to the container halves such that it can be removed again. When stacking the filled containers, the carrying device can be removed respectively from the stacked container and attached to the following container that must be stacked. It is particularly easy to insert the carrying device if it can be manually reduced, counter to a pre-stressing. In accordance with an aspect of the invention, the carrying device has a grip which forms a hinge with at least two pre-stressed parts, which must be moved against each other to reduce the carrying device. The carrying device can always be kept in hand and can be attached to and removed from the container with a simple hand pressure on the container. It is particularly important that the containers can be stacked easily, since these containers frequently must be stacked in the dark or under poor lighting conditions and very hastily.

Further advantageous features follow from the following description when considered in conjunction with the accompanying figures.

DETAILED DESCRIPTION OF THE INVENTION

Figure 1:
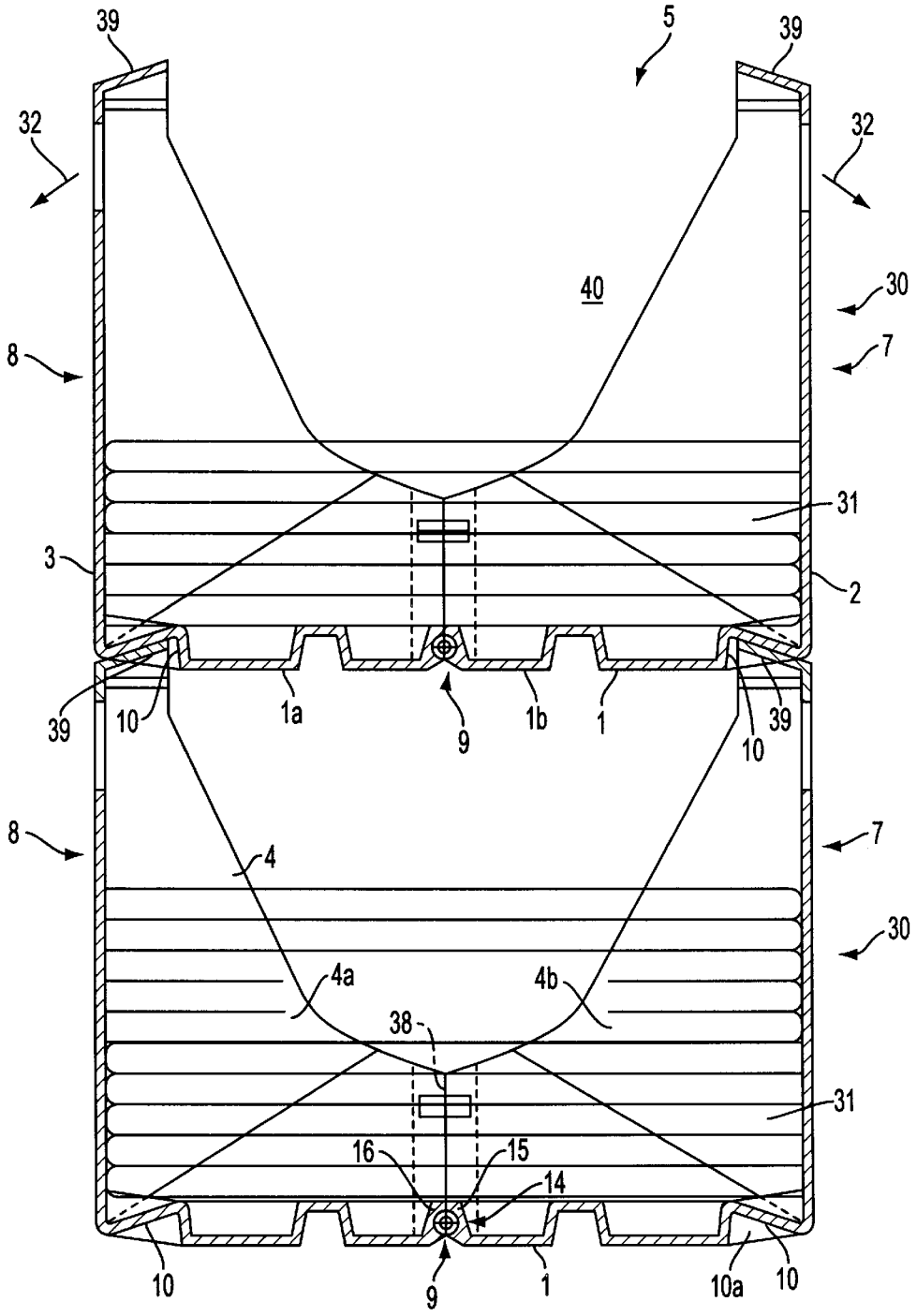
FIG. 1 is section through two containers stacked one above the other.

Referring to FIG. 1, there is shown two identical containers 30 stacked one above the other, each of which has a box shape and is preferably made of plastic. Each container 30 includes two container halves 7 and 8, which are joined securely with the aid of a hinge 9 in the center of the bottom 1 of a respective one of the containers, such that the container halves can pivot to a limited degree. The two halves 7 and 8 can be folded down in the direction of arrows 32, following the release of two latches 11, arranged on the side walls 5 and 4. The locking mechanisms 11 each comprise two interlocking parts 11*a* and 11*b* and prevent an undesirable coming apart of the containers filled with printed products 31 during transport.

Container half 7 comprises a bottom part 1*b*, a side wall 2 and two side-wall halves 4*b* and 5*b*. Container half 8 comprises a bottom part 1*a*, a side wall 3 and two side-wall halves 4*a* and 5*a*. To allow a stable stacking for containers 30, side walls 2 and 3 each have an edge 39 at an upper end that extends essentially over the total length and is inclined toward the inside. Recesses 10 are arranged in bottom 1 that correspond to these two edges 39 and which are limited on the side by a lateral wall 10*a*. FIG. 1 shows clearly that edges 39 engage in recesses 10. Lateral walls 10a prevent a shifting of the containers in the longitudinal direction of containers 30. The recesses 10 simultaneously increase the stiffness of bottom 1.

Hinge 9 comprises several inward pointing tabs 15 and 16, which rest against each other in pairs when container halves 7 and 8 are folded up, thereby forming a locking mechanism 14, which stabilizes bottom 1 in the folded up state. Locking mechanism 14 prevents a collapsing of the container in the direction counter to arrows 32. This is also prevented by edges 38 of wall halves 4*a* and 4*b*, which adjoin when container 30 is filled.

The filling opening 6 is expanded for filling the container 30 with printed products 31 in that the two container halves 7 and 8 are folded apart far enough, so that the narrowing due to edges 39 is canceled. This allows the printed products to fall through the filling opening 6 without touching. In order to guide the printed products 31 for this, side walls 2 and 3 of container halves 7, 8 have openings 12 (FIG. 4, into which vertical longitudinal guide means (not shown) can be inserted.

Figure 2:
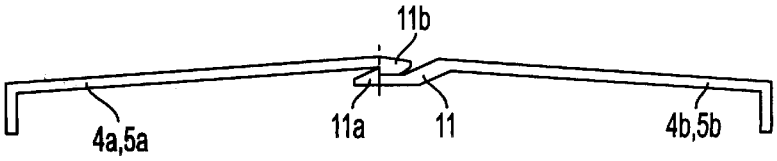
FIG. 2 is a partial plan view of a container according to FIG. 1.
Figure 3:
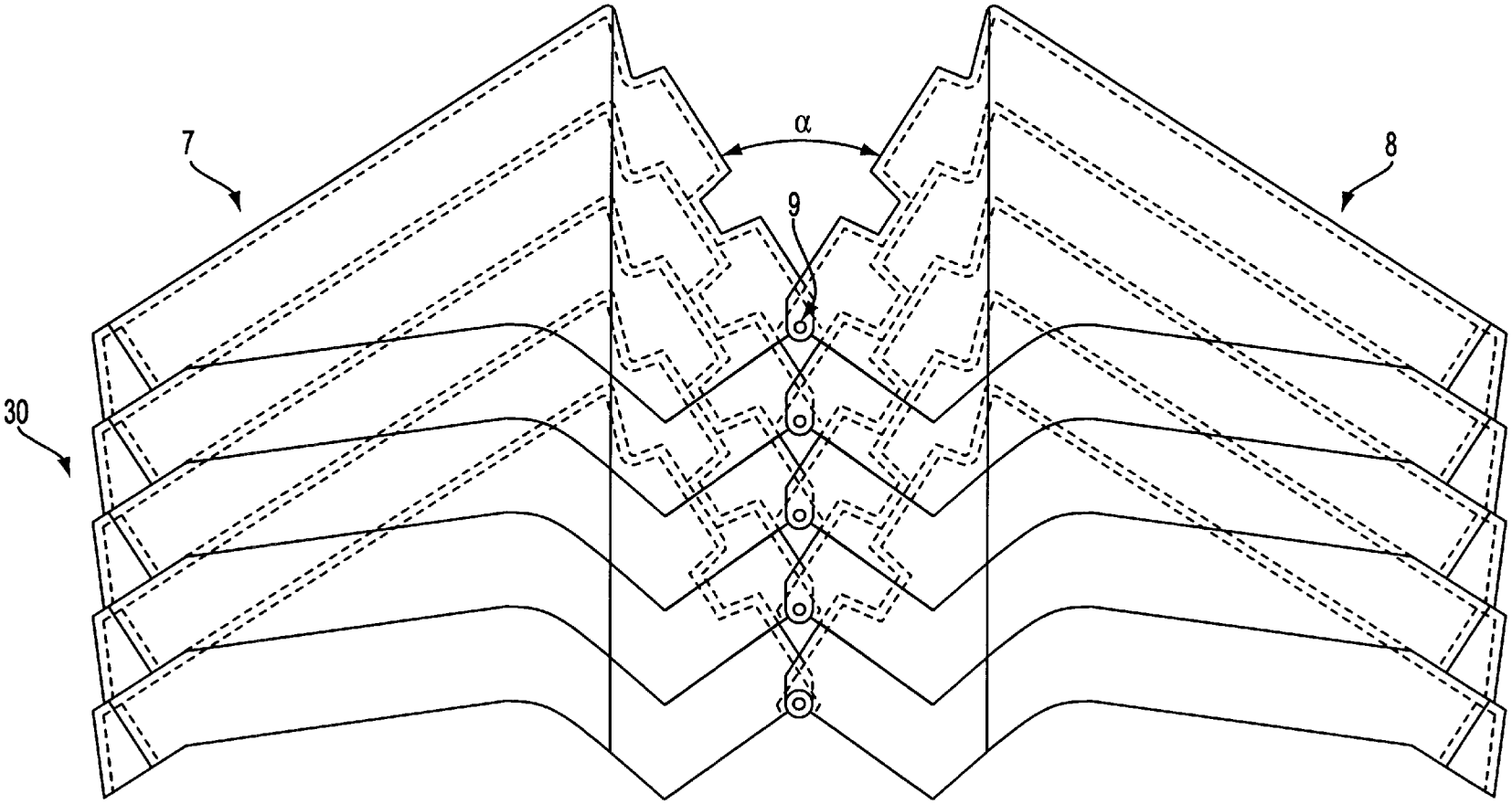
FIG. 3 is a side view of several nested containers in the folded position.

In accordance with FIG. 3, containers 30 can be nested into each other in the folded down state to form a vertical stack. This stack is very compact and at the same time stable. For the nesting into each other, containers 30 are opened by folding down container halves 7 and 8, similar to a shell, and are turned. Thus, the underside of bottom 1 is open in each case, and the bottom half parts 1*a* and 1*b* are arranged such that they form a V-shape according to FIG. 3, wherein the opening angle $\alpha$ is an acute angle, preferably an angle of approximately 60°. So that the containers 30 can be nested into each other and can also be separated easily, the side walls 4 and 5 point conically toward the outside, as is shown in particular in FIGS. 2 and 4. The advantage here is that the side wall halves 4*a* and 4*b* as well as 5*a* and 5*b* have a comparably low height as a result of the opening 40.

Figure 4:
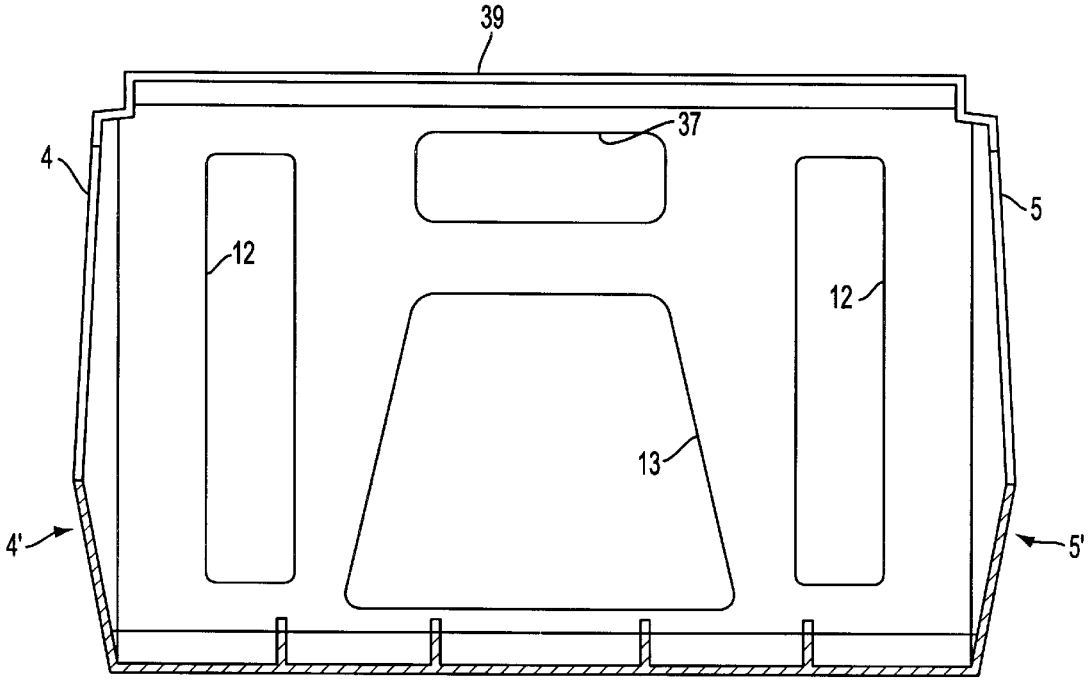
FIG. 4 is vertical section through a container.
Figure 5:
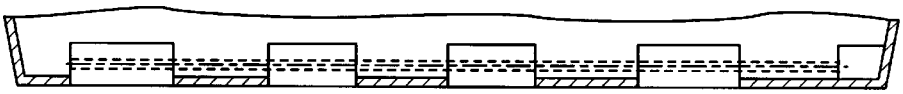
FIG. 5 is partial section through the bottom of a container.

Referring to FIG. 4, side walls 2 and 3 each have an opening 37 so that the filled containers 30 can be carried manually without problems. The respective openings 13 arranged farther down are used as hand holds for emptying the containers 30.

FIG. 4 shows that side walls 4 and 5 having segments 4' and 5' that extend outwardly with respect to the interior of the container.

Figure 6:
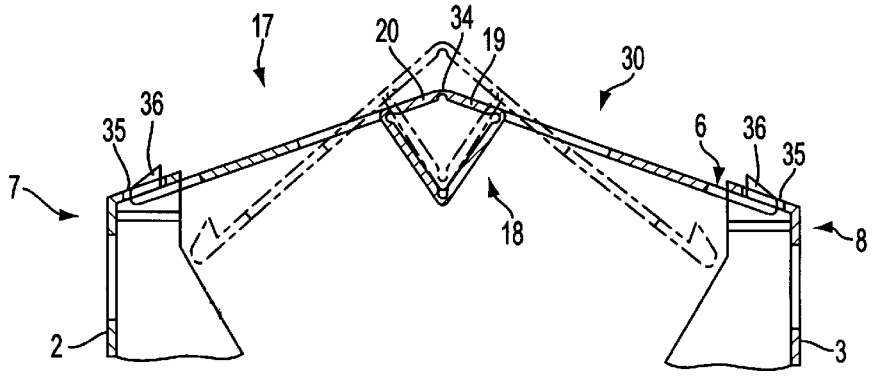
FIG. 6 is section of a portion of the container with an attached carrying device.

A carrying device 7 shown in FIG. 6 permits a particularly easy stacking of the containers 30. This device can be inserted from above into the filling opening 6 and can be attached to container halves 7 and 8. For this, two plate-shaped parts 19 and 20 are attached in a V-shaped arrangement at a centrally located handle 18. The ends of these parts 19 and 20 have claws 36, which can be inserted from below into recesses 35 provided in edges 39, respectively.

In order to insert carrying device 17 into opening 6, carrying device 17 is reduced in that the parts 19 and 20 are moved around a hinge 34 to the arrangement shown with dashed line. If the manual pressure applied from the side to handle 18 is removed, then parts 19 and 20 are forced apart as a result of a pre-stressing, to assume the position shown with drawn-out lines in FIG. 6, in which claws 36 engage in recesses 35, as shown. Carrying device 17 thus is firmly anchored to container halves 7 and 8. In order to release carrying device 17, it is sufficient to apply pressure from the side to handle 18, which returns carrying device 17 to the position shown with the dashed line.

The invention has been described in detail with respect to preferred embodiments, and it will now be apparent from the foregoing to those skilled in the art that changes and modifications may be made without departing from the invention in its broader aspects, and the invention, therefore, as defined in the appended claims is intended to cover all such changes and modifications as fall within the true spirit of the invention.

What is claimed is:

1. A container arrangement for transport of printed product, comprising:

a container including two container halves and a hinge connecting the two container halves so that the two container halves can be pivoted between a folded up position and a folded down position, wherein in the folded up position the container includes a bottom, four side walls and an upper filling opening and is stackable on another like container in the folded up position, and in the folded down position the container is nestable with another like container in the folded down position;

wherein the two container halves include means for releaseably latching together the two container halves in the folded up position.

2. A container arrangement according to claim 1, wherein the hinge connects the two container halves on the bottom of the container.

3. The container according to claim 1, wherein the two container halves each have an edge near the filling opening which edge extends into the filling opening and a recess on the bottom that corresponds to the edge for receiving the edge when the container is stacked on another like container.

4. The container according to claim 1, wherein two of the four side walls face one another and each of the two facing side walls is divided approximately in half and extends outwardly at least in some segments with respect to an interior of the container.

5. The container according to claim 1, wherein two of the four side walls face each other and each of the two facing side walls includes at least one opening for receiving guide means that can be pivoted for filling the container.

6. A container arrangement for transport of printed product, comprising:

a container including two container halves and a hinge connecting the two container halves so that the two container halves can be pivoted between a folded up position and a folded down position, wherein in the folded up position the container includes a bottom, four side walls and an upper filling opening and is stackable on another like container in the folded up position, and in the folded down position the container is nestable with another like container in the folded down position;

wherein the two container halves include locking means for stabilizing the bottom when the two container halves are in the folded up position.

7. The container according to claim 6, wherein the locking means is comprised of parts of the hinge which is arranged in the bottom of the container and said parts fit against one another.

8. A container arrangement for transport of printed product, comprising:

a container including two container halves and a hinge connecting the two container halves so that the two container halves can be pivoted between a folded up position and a folded down position, wherein in the folded up position the container includes a bottom, four side walls and an upper filling opening and is stackable on another like container in the folded up position, and in the folded down position the container is nestable with another like container in the folded down, position the arrangement further including a carrying device comprising a prestressed plate with an approximately V-shaped cross section removably joined with the container halves for insertion into the filling opening.

9. The container according to claim 8, wherein the carrying device can be manually reduced against a pre-stressing for inserting it into the filling opening.

10. The container according to claim 9, wherein the carrying device comprises a handle that forms a hinge, said hinge comprising at least two pre-stressed parts that are movable against each other to reduce the carrying device.

11. The container according to claim 8, wherein each container half includes a catch on which the carrying device can engage.

* * * * *